United States Patent [19]

Firchau et al.

[11] 4,350,177

[45] Sep. 21, 1982

[54] UTILITY BOX SUPPORT

[76] Inventors: John C. Firchau, 6315 Edgewood Way, Rocklin, Calif. 95677; Morris L. Donaldson, 233 Sierra Blvd., Roseville, Calif. 95678

[21] Appl. No.: 148,839

[22] Filed: May 12, 1980

[51] Int. Cl.[3] ..... E02D 29/10

[52] U.S. Cl. ..... 137/370; 137/364; 137/371; 404/26

[58] Field of Search ..... 137/363, 364, 365, 366, 137/367, 370, 371, 368, 369; 404/25, 26

[56] References Cited

U.S. PATENT DOCUMENTS

| | | | |
|---|---|---|---|
| 81,266 | 8/1868 | Finnegan | 404/26 X |
| 891,207 | 6/1908 | Connolly | 137/369 |
| 1,710,571 | 4/1929 | Forni | 404/26 |
| 3,220,433 | 11/1965 | Steil | 137/363 |
| 4,187,647 | 2/1980 | Hall | 404/26 X |

FOREIGN PATENT DOCUMENTS

| | | | |
|---|---|---|---|
| 101409 | 2/1963 | Norway | 137/364 |

*Primary Examiner*—Gerald A. Michalsky
*Attorney, Agent, or Firm*—Blair, Brown & Kreten

[57] ABSTRACT

A support for a utility box such as a valve box or the like which includes an annular member having a central opening with an upstanding flange on the upper surface of the annular member adjacent the central opening. The annular member is buried in the ground in underlying supporting engagement with a box so as to prevent sinking of the box into the ground under heavy traffic load, said box provides access to the buried utility the upper end of the box opening into the street.

3 Claims, 3 Drawing Figures

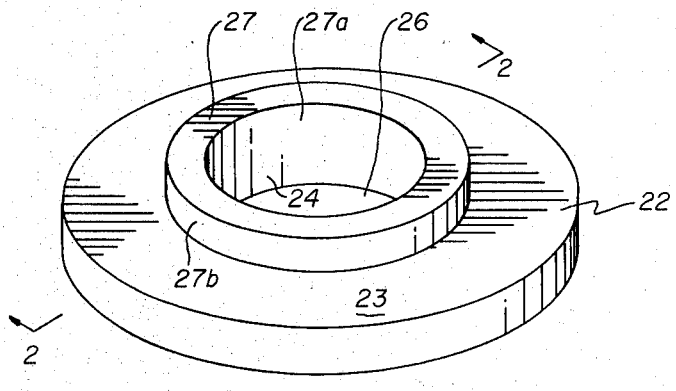
FIG 1
FIG 2
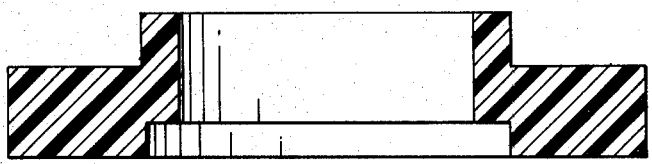
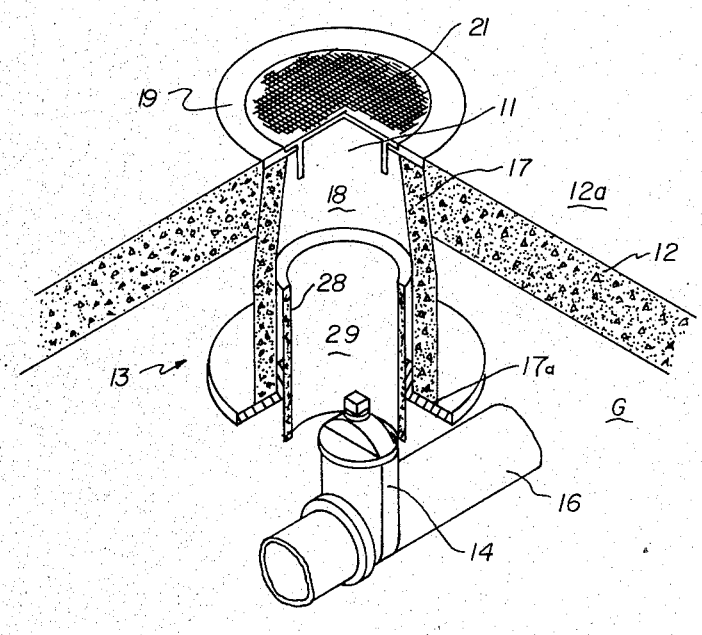
FIG 3

UTILITY BOX SUPPORT

BACKGROUND OF THE INVENTION

The common practice in the installation of underground utilities such as water lines and the like is to provide access to valves or the like and, a tubular housing is buried in the ground so that the interior of the housing provides access to the buried equipment from the surface. The open upper end of such tubular housings, commonly referred to as "utility boxes" is generally provided with a removable cover lid disposed in substantially flush relationship with the top surface of the ground. Such utility boxes are frequently installed in streets, walks and the like so as to subject such utility boxes to repeated loads as a result of the traffic moving over such boxes.

Such utility boxes, which may include valve boxes, monument housing boxes, etc., are usually formed of metal, concrete or plastic and as a result of the loading action of such traffic on the boxes, there is a tendency for such boxes to gradually sink into the ground over a period of time, with the result that the area of the street or pavement adjacent to and/or including the box settles creating undesirable depressions in the street surface with attendant destructive affects on both the utility box itself and vehicles traveling thereover as well as creating a safety hazard for pedestrians or the like.

OBJECTS AND SUMMARY OF THE INVENTION

Accordingly, a primary object of this invention is to provide a novel support for a utility box installation which opposes the sinking of the box in heavy traffic areas.

Another object of this invention is to provide a novel support for a utility box which requires no modification of the box for installation and which is easily adapted to presently manufactured utility boxes throughout a wide variety of sizes and configurations.

Still another object of this invention is to provide a novel support for a utility box which is simple and inexpensive in construction, which may be simply and easily installed during the installation of the box, and which may be formed of any suitable inexpensive material.

The objects of the invention and other related objects are accomplished by the provision of an annular member having a central opening provided with a upstanding annular flange on the upper surface of the annular member adjacent the central opening. The support of the invention is utilized with a utility box having a housing which is installed so as to extend below ground level, the housing having an interior defining an access passage to a buried utility such as a water valve or the like. The annular member is installed in the ground with its upper surface in supporting engagement with the bottom edge of the installed housing with the annular flange extending within the tubular housing to prevent lateral shifting of the housing, so that sinking of the housing in the ground is opposed by the buried annular member.

Other objects and accomplishments of the invention will become apparent when viewed in the light of the following description taken in conjunction with the accompanying drawing.

BRIEF DESCRIPTION OF THE DRAWING

FIG. 1 is a perspective view of the support according to the invention;

FIG. 2 is a sectional view taken substantially along lines 2—2 of FIG. 1 in the direction of the arrows; and FIG. 3 is a perspective view partially in sections of a typical utility box installation incorporating the use of the invention.

DESCRIPTION OF THE PREFERRED EMBODIMENT

Referring now to the drawing and to FIG. 3 in particular there is shown a typical below grade installation of a utility box for providing an access opening 11 in the surface 12*a* of a street, walk or the like 12 of the type which is usually subjected to heavy traffic. The utility box of FIG. 3, designated generally by the reference numeral 13, is of the type providing access through the surface opening 11 to a buried utility device such as a valve 14 installed in a water line 16 or the like.

As is well known, such a utility or valve box 13 includes a substantially closed side wall structure or housing 17 having an interior 18 the upper end of which defines the surface opening 11. The housing 17 is preferably formed of a suitable aggregrate in the well known manner and is installed within the street layer or pavement 12 as shown in FIG. 3. The upper end of the housing 17 is preferably provided with an annular grade ring 19 of metal or the like which is at street level in the pavement surface 12*a* and accommodates a removable cover lid 21 in the well known manner. Removal of the cover lid 21 provides access from the street through the interior 18 to the valve 14.

As specifically illustrative of the invention, and as shown best in FIG. 1, the support of the invention includes an annular member 22, formed of plastic or the like, having an upper surface 23 and an annular inner edge 24 defining a central opening 26 preferably circular in shape. The annular member 22, which is also preferably of circular shape, is provided with an upstanding annular flange 27 placed adjacent the central opening 26. The annular flange 27 includes an inner peripheral surface 27*a* which is substantially flush with the edge 24 of the annular member 22 as shown best in FIG. 1. The outer diameter of the flange 27 formed by the flange outer periphery 27*b* corresponds substantially to the inner diameter of the housing 17 so as to be accommodated within the lower end of the housing 17.

In the use of the support according to the invention during installation of the utility box 13, the annular member 22 is buried in the ground G as shown in FIG. 3, and the housing 17 positioned on the upper surface 23 of the annular member 22. By engagement of the bottom edge 17*a* of the housing 17 with the surface 23, the outer periphery 27*b* of the annular flange 27 is therefore disposed in engagement with the inner surface of the housing 17 thereby maintaining the access opening formed by the interior 18 in vertical alignment with the central opening 26 for easy access to the valve 14. As a result of the burying of the annular member 22 in underlying relationship with the housing 17, shock loads imposed on the housing 17 by traffic or the like on the pavement surface 12*a* is distributed throughout the upper surface 23 of the annular member 22 and sinking of the housing 17 into the ground is opposed and virtually eliminated.

In the preferred embodiment of the utility box 13, an inner riser or standpipe 28 is disposed within the interior 18 of the housing 17 in telescoping relationship therewith as shown in FIG. 3. The interior 29 of the riser 28 is therefore disposed in alignment with the central opening 26 in the annular member 22 and the interior 18 of the utility box 17 so as to provide access to the valve 14 while preventing the collapse of the surrounding earth into the area in the vicinity of the valve 14.

Having thus described the preferred embodiment of the invention it should be understood that numerous structural modifications and adaptations may be resorted to without departing from the spirit of the invention.

What is claimed is:

1. A utility box and support comprising in combination:

an annular member, substantially circular in shape having planar parallel upper and lower surfaces and a central opening, an upstanding annular flange formed integrally with said annular member having a circular central opening flush with said member opening and dimensioned to leave a peripheral portion of said planar upper surface exposed which supports the utility box formed as a tubular housing having a bottom edge surface disposed atop said planar top surface whereby an interior of said tubular housing is in registry with said central opening and constrained from radial displacement by a snug fit over said flange, said housing including a grade ring on a top edge surface thereof coplanar with a traffic bearing surface.

2. The device in accordance with claim 1 wherein the utility box includes a tubular member disposed within the interior of said housing in telescoping relationship therewith, said tubular member having an outer diameter corresponding substantially to an inner diameter of said annular flange opening whereby said annular flange is sandwiched between said tubular member and said housing.

3. A support in accordance with claim 2 wherein said annular member and said annular flange are formed of plastic in a one-piece construction.

* * * * *